US006023227A

United States Patent [19]

Yanko et al.

[11] Patent Number: 6,023,227

[45] Date of Patent: Feb. 8, 2000

[54] ALERTING SYSTEM AND METHOD FOR MAINTAINING THE AWARENESS OF A DRIVER

[76] Inventors: Gersh Froim Yanko, 20 Randall St., Apt. #5L, Providence, R.I. 02904; Alexander Gersh Yanko, 109 Kirkwood Dr., Cranberry, Pa. 16066

[21] Appl. No.: 09/286,078

[22] Filed: Apr. 5, 1999

[51] Int. Cl.[7] ..... G08B 23/00

[52] U.S. Cl. ..... 340/576; 340/439; 180/272; 701/70

[58] Field of Search ..... 340/576, 439, 340/425.5, 575; 180/272, 273; 701/70

[56] References Cited

U.S. PATENT DOCUMENTS

| | | | |
|---|---|---|---|
| 3,409,101 | 11/1968 | Williams | 340/439 |
| 4,234,051 | 11/1980 | Moria | 340/575 |
| 5,402,108 | 3/1995 | Tabin | 180/272 |
| 5,469,143 | 11/1995 | Cooper | 340/575 |
| 5,675,313 | 10/1997 | Keluskar | 340/425.5 |
| 5,835,008 | 11/1998 | Colemere, Jr. | 340/439 |

*Primary Examiner*—Nina Tong

[57] ABSTRACT

The disclosed apparatus and method for maintaining the awareness of a vehicle's driver comprises an accelerator pedal (15) and activating means (21) for actuating the vehicle's warning system (17), the design of which is fulfilled in such a way, that the driver normally operates the accelerator pedal by means of his foot at a predetermined position on it, which guarantees his awareness. As soon, as he starts to lose awareness, the given position of his foot changes involuntarily, which engages the warning system.

6 Claims, 2 Drawing Sheets

ALERTING SYSTEM AND METHOD FOR MAINTAINING THE AWARENESS OF A DRIVER

BACKGROUND OF THE INVENTION

The invention relates to the alerting systems for maintaining the awareness of a vehicle's driver.

When the drive is fatigued from work, or operates his vehicle for extended time without rest, or the like—such a long monotonous drive can cause the driver to become inattentive to his driving. Failure of the driver to be alert and pay attention to proper operation of the vehicle is hazardous both to the driver and to other vehicles on the road. Nevertheless, in general, drivers don't realize their condition and tend to continue to drive their vehicles regardless of their ability to do it properly.

To prevent this a device has been proposed, U.S. Pat. No. 5,469,143 to Cooper (1995), which includes a pair of eyeglasses, comprising a micro-switch, coupled to a sensing lever, that is in constant contact with one of the driver's upper eyelid muscles, and electrically connected to a control unit. If the driver's eyelid fails to open at a predetermined time, the chain "sensing lever—micro-switch—control unit" produces an alarm signal.

Besides its complexity and inconvenience in use, this device is not reliable enough, because it is known that for some people open eyes do not mean that they are in an alert state.

One more safety device has been proposed, U.S. Pat. No. 3,409,101 to Williams (1968), which is implemented as a special foot pedal on the floor of the driver's compartment, which, upon depression, will activate an indicator switch for generating an alert signal, when the driver relaxes his pressure on the pedal, because he starts to drowse.

Besides the inconvenience of providing of not related to the driving process additional article to already crowded pedal area, said technical solution is not reliable enough, because it counts on a premise, that the drowsing driver will relax the pressure of his foot to the pedal, which is not quite true; the driver may be asleep and still apply the weight of his foot to the pedal.

Another device has been proposed in the U.S. Pat. No. 5,402,108 to Tabin (1995), wherein a signal for requesting a driver's response is provided in a time interval, and a decrease in driver's awareness is determined from a response time of the driver to the given signal.

The basic principle of "Alertness detecting and warning system for automobile" disclosed in U.S. Pat. No. 5,675,313 to Keluskar (1997) is, that the driver is required to use at least one of the pedals—either an accelerator, or brake, or special auxiliary pedal—during the predetermined time. Failure of the driver to do so initiates the warning system.

U.S. Pat. No. 4,234,051 to Moria discloses a driver alertness device, which includes a decrementing counter, that is resettable by the driver, a display to be observed by the driver, and a warning system. The driver must reset the decrementing counter before it reaches the predetermined time setting (between 0 and 10 minutes), as indicated by the display. Failure of the driver to do that results in activation of the warning system.

The verification of driver's awareness in apparatuses shown in U.S. Pat. No. 3,409,101, No. 5,402,108, No. 5,675,313, and No. 4,234,051 is based on his special actions in response to, or to avert the preliminary signals, which become additional to driver's common duties, distract him from operating his vehicle and make him more tired.

None of the above-mentioned solutions considers the fact, that a decrease of the level of the driver's awareness may occur (and does occur) at any time during the predetermined intervals between the preliminary signals. Thus, they admit, that for some indefinite time the vehicle may be operated by an inattentive driver, which undermines the whole idea behind this kind of devices.

A primary objective of the present invention is to provide an immediate activation of the warning/alarm system as soon as the driver's awareness starts to decrease, regardless of his recognition of that.

SUMMARY OF THE INVENTION

In accordance with this goal there is provided an alerting system and method for maintaining the awareness of a driver which controls a vehicle, having a throttle, operated by an accelerator pedal via linkage, and a warning/alarm system. Said alerting system comprises activating means for actuating of said warning/alarm system. The action of said alerting system is based on a known fact, that the drowsiness and the initial stages of sleep are typically accompanied by an involuntary relaxation of the muscles of the human body and its parts, which normally have been tensioned while they perform their functions.

Utilizing that, the design of the accelerator pedal and activating means is fulfilled in such a way, that a driver normally operates an accelerator pedal with his foot in a certain position, and within predetermined lateral boundaries, guaranteeing his awareness. As soon as he starts to lose his awareness, the given position of his foot changes involuntarily, which engages the warning/alarm system.

The advantages of the present invention will become apparent by referencing the following detailed description thereof, when read in conjunction with the attached drawings.

DRAWING FIGURES

REFERENCE NUMERALS IN DRAWINGS

Figure 1:
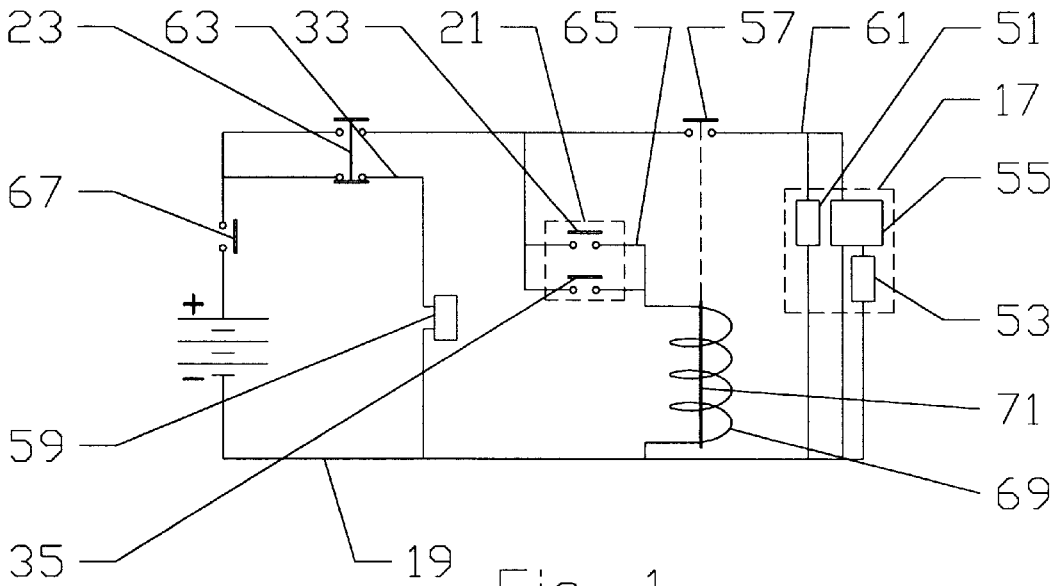
FIG. 1 is a principal electrical scheme of the alerting system, designed in accordance with the present invention.
Figure 2:
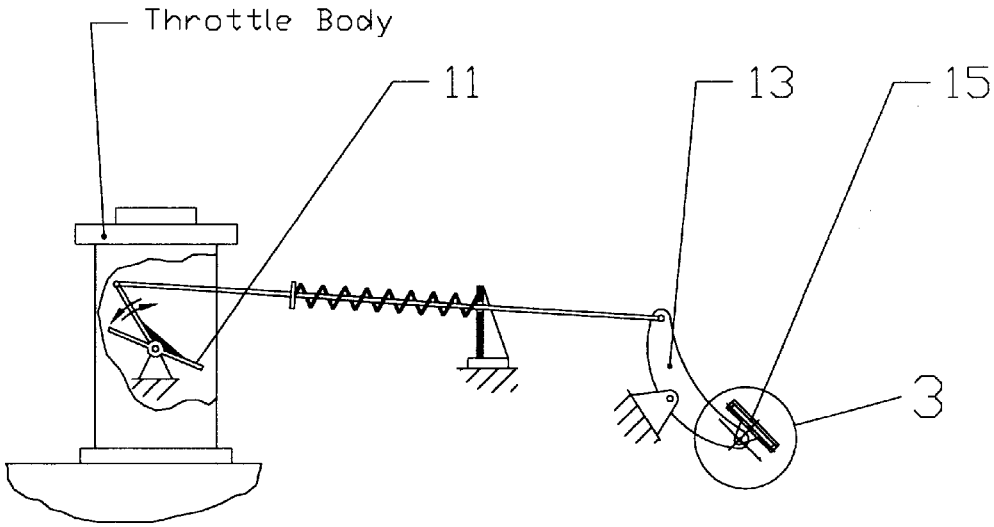
FIG. 2 is a view of a throttle linkage with an accelerator pedal.
Figure 4:
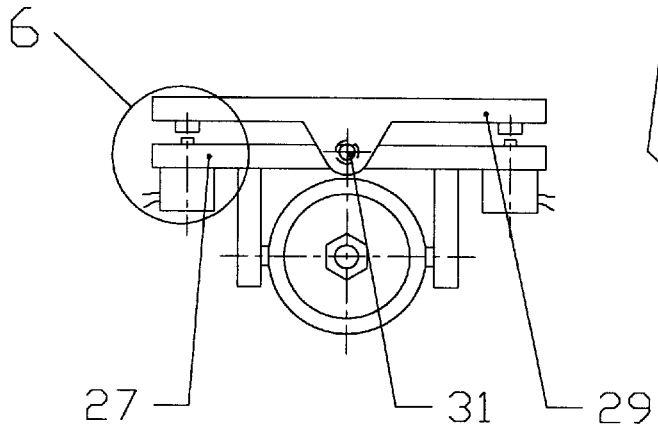
FIG. 4 is view 4 from FIG. 3.

11 throttle
13 linkage
15 accelerator pedal
17 warning/alarm system
19 electrical circuit
21 activating means
23 On/Off switch
25 holder
27 pedal member
29 plate
30 pivot
31 spring
33 activator
35 activator
51 horn

53 emergency flashers
55 time delay means
57 switch
59 cruise control means
61 circuit
63 circuit
65 circuit
67 ignition switch
69 solenoid
solenoid core

DESCRIPTION

The alerting system for maintaining the awareness of a driver, which controls a vehicle, having a throttle 11, operated via linkage 13 by an accelerator pedal 15, and a warning/alarm system 17. Said alerting system includes activating means 21 for actuating said warning/alarm system, and electrical circuit 19 with an On/Off switch 23 for setting said alerting system "On" or "Off".

Accelerator pedal 15 comprises a holder 25, fixed on linkage 13, a pedal member 27, connected to holder 25, and a plate 29, attached to pedal member 27 by a pivot 30, and turnable in a transverse plane of said vehicle. Plate 29 has been kept in an equilibrium state by the springs 31.

Activating means 21 comprises activators 33 and 35, implemented as pushbutton switches located on pedal member 27.

Warning/alarm system 17 is pre-arranged to alert the driver, who has lost self-control and to warn other participants of traffic, that this particular vehicle is not in order. It includes a vehicle's conventional horn 51, emergency flashers 53, a time delay means 55 for lag of the operation of emergency flashers 53, and a switch 57 for control of circuit 61 of warning/alarm system 17. Horn 51 and emergency flashers 53, being connected to the conventional electrical circuit of a vehicle, are also incorporated in the electrical circuit of said alerting system, so that, when the On/Off switch 23 is in position "On" they become controlled by said alerting system too.

Many contemporary vehicles come equipped with cruise control means 59 for maintaining a vehicle at a given speed. While using this feature the driver does not use the accelerator pedal to control the throttle position.

Since the function of said alerting system, as mentioned above, is based on the analysis of the driver's foot position on the accelerator pedal, the design of said alerting system predetermine that, when the On/Off switch 23 is turned into the position "On", it breaks circuit 63 of cruise control means 59. The cruise control means become disable, so the driver must use the accelerator pedal to control the speed of the vehicle, thus said alerting system is able to accomplish its functions.

Operation

FIG. 1 shows the basic state of said alerting system, shut off: the driver can control the vehicle in a conventional manner, and he may use cruise control means 59.

By turning On/Off switch 23 into the position "On" the driver breaks circuit 63, disabling cruise control means 59, and prepares said alerting system for functioning.

The design of said alerting system predetermines that for normal driving of the vehicle (without involving the warning/alarm system) the driver should operate the accelerator pedal by his foot, placed on plate 29 in such a position that the axis of application of load from his foot onto plate 29 is passing through pivot 30 of plate 29. Thus, plate 29 is still kept in an equilibrium position with some insignificant free play around pivot 30.

Figure 5:
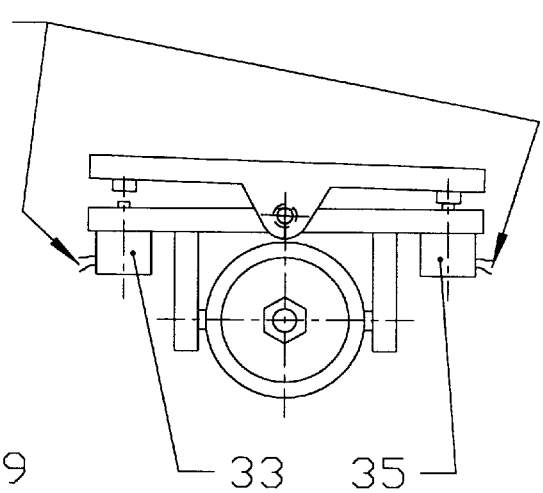
FIG. 5 is a position of the accelerator pedal, in which the warning/alarm system becomes engaged.
Figure 3:
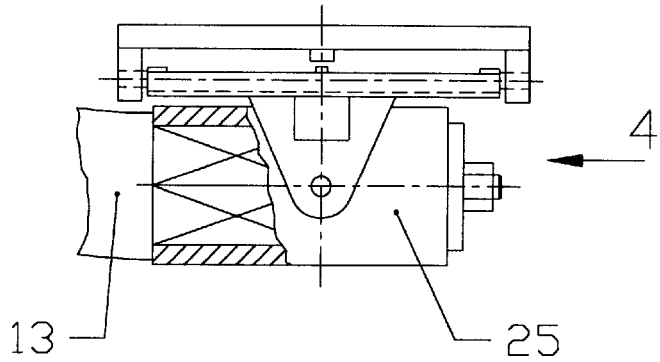
FIG. 3 is view 3 of an accelerator pedal from FIG. 2, turned.
Figure 6:
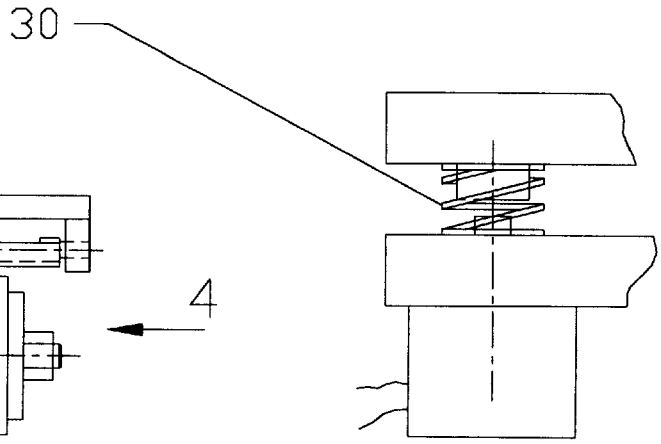
FIG. 6 is view 6 from FIG. 4.

When the driver gets into an inattentive condition—drowsiness, initial stage of sleep, etc., or even if he becomes merely distracted, the leg, that transfers the load to the accelerator pedal through the foot, tends to relax by turning outward from the given upright position. It is an involuntary reaction to the twisting stress produced in said leg in the process of application of load to the accelerator pedal, and directed inward. Plate 29, which interacts with said foot, becomes turned outwards (clockwise—see FIG. 5) also, engaging activator 35. Now circuit 65 is closed, solenoid 69 becomes energized and pulls in solenoid core 71, closing switch 57 and, subsequently, completing circuit 61 of warning/alarm system 17. Horn 51 becomes activated immediately—to attract the driver's attention; emergency flashers 53—after a time, predetermined by time delay means 55, to warn other participants of traffic, that this vehicle is in possible trouble. If the driver manages to get the system to the normal status during said predetermined time, emergency flashers 53 will not be engaged.

If for any reason plate 29 turns in opposite direction, it engages activator 33, which sets off the warning/alarm system the same, as it was described earlier for activator 35.

To stop the warning/alarm system's signal(s) or to disable said alerting system in case the driver considers himself being in a good alert state and wants to use cruise control means 59, On/Off switch 23 should be put into the "Off" position. By doing that, circuits 61 and 65 becomes de-energized, and circuit 63 of cruise control means gets closed.

Summary, Ramifications and Scope

There are several advantages of the described alerting system:

- it is reliable—it reacts to the driver's inattentiveness instantly, so the vehicle is not ever left without control;
- it does not require the driver to perform any extra activities in addition to his normal driving duties to affirm his awareness;
- it does not require any major changes to the design of the vehicle, furthermore, it utilizes some of existing vehicle's accessories;
- it is relatively simple and inexpensive;
- it can be easily installed on new vehicles (by manufacturer), as well as on used ones (by any automotive shop);
- it can be used on vehicles with different designs of the accelerator pedal;
- it can be used on vehicles, which have been provided with cruise control means, as well as those, which don't have this feature.

The description above should not be construed as a limitation to the scope of the invention, but as merely providing an illustration of the presently preferred embodiment of this invention. For example, the role of the described activator could be played by some kind of known spring return switch, or analog angle sensor adapted to interact with plate 29; the warning/alarm system of the described embodiment comprises the vehicle's horn and emergency flashers, but it is apparent that numerous other warning signals can be equally well implemented; likewise, any type of relay, etc., can play the role of the solenoid. The mechanical design of said alerting system can be laid out differently, still serving the main idea of monitoring of the position of driver's leg as a measure of his alertness.

Thus, the scope of the invention should be determined by the appended claims and their legal equivalents, rather than by example given.

We claim:

1. An alerting system for maintaining the awareness of a driver of a vehicle, said vehicle includes an accelerator pedal for controlling a throttle via a linkage, and a warning/alarm system, wherein said alerting system comprises:

an electrical circuit comprising an On/Off switch for turning said alerting system either "On" or "Off" manually; wherein said electrical circuit is coupled to said warning/alarm system;

an activating means is mounted on said accelerator pedal and coupled to said electrical circuit for actuating of said warning/alarm system;

a plate is mounted on said accelerator pedal pivotal in a transverse plane of said vehicle and is able to interact with said activating means;

said activating means actuates said warning/alarm system, when said driver's foot presses on said accelerator pedal via said plate with any involuntary inwards/outwards movement, causing the interaction between said plate and said activating means, upon an initial stage of losing of the awareness of said driver.

2. The alerting system of claim 1, wherein said accelerator pedal, further comprising a holder, which is fixed on said linkage, and a pedal member of said accelerator pedal to which said plate is connected.

3. The alerting system of claim 1, wherein said activating means comprises at least one activator.

4. The alerting system of claim 1, wherein said warning/alarm system comprises a vehicle's horn, and emergency flashers, which, being coupled to said electrical circuit, can be controlled by said alerting system as well.

5. The alerting system of claim 1, further comprising a cruise control means for maintaining said vehicle at a given speed, wherein said cruise control means is coupled to said electrical circuit, such that said cruise control means is disabled, when said alerting system is switched on, and said cruise control means is able to be activated only when said alerting system is switched off.

6. A method for maintaining the awareness of a driver of a vehicle, based on the relationship between the state of awareness of said driver and involuntary movements of his body and its parts due to the ability of body muscles to relax when the driver gets into an unconscious state, for a vehicle having an accelerator pedal, and a warning/alarm system, said method comprising the steps of:

determining the position of said accelerator pedal, operated by said driver's foot, which corresponds to the required level of said driver's awareness;

monitoring the deviation of the position of said accelerator pedal in a transverse plane of said vehicle from said determined position; wherein said deviation is produced by an involuntary inward/outward movement of the driver's foot, indicating an unconscious state of said driver;

actuating of said warning/alarm system in response to said monitored deviation of the said position.

* * * * *